US006228441B1

(12) United States Patent
Suzuki et al.

(10) Patent No.: US 6,228,441 B1
(45) Date of Patent: May 8, 2001

(54) REWRITEABLE IMAGE-RECORDING SUBSTRATE, IMAGE-RECORDING APPARATUS AND IMAGE-ERASING APPARATUS THEREFOR

(75) Inventors: Minoru Suzuki, Tochigi; Hiroshi Orita; Hiroyuki Saito, both of Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/267,707

(22) Filed: Mar. 15, 1999

(30) Foreign Application Priority Data

Mar. 16, 1998 (JP) ..... 10-084949

(51) Int. Cl.[7] ..... B41M 5/36

(52) U.S. Cl. ..... 428/12; 428/34.1; 428/34.9; 428/35.7; 428/36.9; 428/195; 428/913; 346/76.1

(58) Field of Search ..... 428/12, 34.1, 34.9, 428/35.7, 36.9, 195, 913; 346/76.1

(56) References Cited

U.S. PATENT DOCUMENTS

| | | | |
|---|---|---|---|
| 4,399,209 | 8/1983 | Sanders et al. | 430/138 |
| 4,440,846 | 4/1984 | Sanders et al. | 430/138 |
| 4,644,376 | 2/1987 | Usami et al. | 503/215 |
| 5,825,985 | 10/1998 | Asai et al. | 395/108 |

FOREIGN PATENT DOCUMENTS 4-4960 1/1992 (JP) .

*Primary Examiner*—Bruce H. Hess
(74) *Attorney, Agent, or Firm*—Greenblum & Bernstein, P.L.C.

(57) ABSTRACT

A rewriteable image-recording substrate has a base sheet, and an image-developing layer coated over a surface of the base sheet. The image-developing layer is composed of a plurality of split-tube elements formed of a shape memory resin exhibiting a predetermined glass-transition temperature. Each of the split-tube elements has a split formed along a central axis thereof, and is securely adhered to the surface of the base sheet such that the split of each split-tube element is oriented away from the surface of the base sheet. An outer peripheral surface of each split-tube element is colored with, for example, white, and an inner cylindrical surface thereof is colored with, for example, black.

19 Claims, 12 Drawing Sheets

REWRITEABLE IMAGE-RECORDING SUBSTRATE, IMAGE-RECORDING APPARATUS AND IMAGE-ERASING APPARATUS THEREFOR

BACKGROUND OF THE INVENTION

1. Field of the Invention

The present invention relates to an image-recording substrate coated with an image-developing layer, an image-recording apparatus for developing and recording an image on the image-developing layer of the image-recording substrate, and an image-erasing apparatus for erasing a developed and recorded image from the image-developing layer of the image-recording substrate.

2. Description of the Related Art

As a representative type of image-recording substrate coated with an image-developing layer, a photographic paper coated with a photosensitive emulsion layer is well known. Of course, after an optical image is once developed and recorded on the photographic paper, it is impossible to erase the recorded image from the photographic paper. Namely, the photographic paper cannot be repeatedly used for recording an image.

SUMMARY OF THE INVENTION

Therefore, an object of the present invention is to provide a rewriteable image-recording substrate coated with an image-developing layer, on which an image can be eraseably developed and recorded.

Another object of the present invention is to provide an image-recording apparatus for developing and recording an image on such a rewritable image-recording substrate.

Yet another object of the present invention is to provide an image-erasing apparatus for erasing a developed and recorded image from such a rewriteable image-recording substrate.

In accordance with a first aspect of the present invention, there is provided a rewriteable image-recording substrate comprising a base member, and an image-developing layer, that coats a surface of the base member, composed of a plurality of split-tube elements formed of a shape memory resin exhibiting a predetermined glass-transition temperature. A split is formed along a central axis of each of the split-tube elements, and the each split-tube element is securely adhered to the surface of the base member such that the split is oriented away from the surface of the base member. An outer peripheral surface of the each split-tube element is colored with a first single-color, an inner cylindrical surface of the each split-tube element is colored with a second single-color.

Preferably, the surface of the base member exhibits the first single-color. The first single-color may be white, and the second single-color may be black.

In accordance with the first aspect of the present invention, there is also provided an image-recording apparatus, that develops and records an image on the image-developing layer according to the first aspect of the present invention, comprises a thermal heater that selectively heats a localized area of the image-developing layer of the image-recording substrate to a temperature beyond the predetermined glass-transition temperature in accordance with image-pixel information, and a pressure applicator that exerts a predetermined pressure on the localized area, heated by the thermal heater, such that a split-tube element, included in the localized area, is deformed and spread out so as to exhibit the second single-color.

Preferably, the image-recording apparatus further comprises a cooling unit that cools the deformed and spread-out element to a temperature below the predetermined glass-transition temperature.

In accordance with the first aspect of the present invention, there is further provided an image-erasing apparatus that erases an image, developed and recorded by the image-recording apparatus according to the first aspect of the present invention, on the image-developing layer of the image-recording substrate, comprising a thermal heater that heats the image-recording substrate to a temperature beyond the predetermined glass-transition temperature.

In accordance with a second aspect of the present invention, there is provided a rewriteable image-recording substrate comprising a base member, and an image-developing layer, that coats a surface of the base member, composed of a plurality of split-tube elements including a first type of split-tube element formed of a shape memory resin exhibiting a first predetermined glass-transition temperature, and a second type of split-tube element formed of a shape memory resin exhibiting a second predetermined glass-transition temperature. The first and second types of split-tube elements are regularly and uniformly oriented and arranged over the surface of the base member. A split is formed along a central axis of each of the split-tube elements, and the each split-tube element is securely adhered to the surface of the base member such that the split is oriented away from the surface of the base member. An outer peripheral surface of the first and second types of split-tube elements is colored with a first single-color. An inner cylindrical surface of the first type of split-tube element is colored with a second single-color, and an inner cylindrical surface of the second type of split-tube element being colored with a third single-color. Preferably, the surface of the base member exhibits the first single-color, which may be white.

In accordance with the second aspect of the present invention, there is also provided an image-recording apparatus that develops and records a color image on the image-developing layer of the image-recording substrate according to the second aspect of the present invention, comprising a first thermal heater that selectively heats a localized area of the image-developing layer of the image-recording substrate to a temperature beyond the first predetermined glass-transition temperature in accordance with first image-pixel information, first pressure applicator that exerts a first predetermined pressure on the localized area, heated by the first thermal heater, such that only the first type of split-tube element, included in the localized area, is deformed and spread-out to exhibit the second single-color, a second thermal heater that selectively heats a localized area of the image-developing layer of the image-recording substrate to a temperature beyond the second predetermined glass-transition temperature in accordance with second image-pixel information, and a second pressure applicator that exerts a second predetermined pressure on the localized area, heated by the second thermal heater, such that only the second type of split-tube element, included in the localized area, is deformed and spread-out to exhibit the third single-color.

Preferably, the image-recording apparatus further comprises a first cooling unit that cools the first type of deformed and spread-out element to a temperature below the first predetermined glass-transition temperature, and a second cooling unit that cools the second type of deformed and spread-out element to a temperature below the second predetermined glass-transition temperature.

In accordance with the second aspect of the present invention, there is further provided an image-erasing apparatus that erases a color image, developed and recorded by the image-recording apparatus according to the second aspect of the present invention, on the image-developing layer of the image-recording substrate, comprising a thermal heater that heats the image-recording substrate to a temperature beyond the first and second predetermined glass-transition temperatures.

In accordance with a third aspect of the present invention, there is provided a rewriteable image-recording substrate comprising a base member, and an image-developing layer, that coats a surface of the base member, composed of a plurality of split-tube elements including a first type of split-tube element formed of a shape memory resin exhibiting a first predetermined glass-transition temperature, a second type of split-tube element formed of a shape memory resin exhibiting a second predetermined glass-transition temperature, and a third type of split-tube element formed of a shape memory resin exhibiting a third predetermined glass-transition temperature. The first, second and third types of split-tube elements are regularly and uniformly oriented and arranged over the surface of the base member. A split is formed along a central axis of each of the split-tube elements, and the each split-tube element is securely adhered to the surface of the base member such that the split is oriented away from the surface of the base member. An outer peripheral surface of the first, second and third types of split-tube elements is colored with a first single-color. An inner cylindrical surface of the first type of split-tube element is colored with a second single-color, an inner cylindrical surface of the second type of split-tube element is colored with a third single-color, an inner cylindrical surface of the third type of split-tube element is colored with a fourth single-color. Preferably, the surface of the base member exhibits the first single-color, which may be white. The respective second, third and fourth single-colors may be yellow, magenta and cyan.

In accordance with the third aspect of the present invention, there is also provided an image-recording apparatus that develops and records a color image on the image-developing layer of the image-recording substrate according to the third aspect of the present invention, comprising a first thermal heater that selectively heats a localized area of the image-developing layer of the image-recording substrate to a temperature beyond the first predetermined glass-transition temperature in accordance with first image-pixel information, a first pressure applicator that exerts a first predetermined pressure on the localized area, heated by the first thermal heater, such that only the first type of split-tube element, included in the localized area, is deformed and spread-out to exhibit the second single-color, a second thermal heater that selectively heats a localized area of the image-developing layer of the image-recording substrate to a temperature beyond the second predetermined glass-transition temperature in accordance with second image-pixel information, a second pressure applicator that exerts a second predetermined pressure on the localized area, heated by the second thermal heater, such that only the second type of split-tube element, included in the localized area, is deformed and spread-out to exhibit the third single-color, a third thermal heater that selectively heats a localized area of the image-developing layer of the image-recording substrate to a temperature beyond the third predetermined glass-transition temperature in accordance with third image-pixel information, and a third pressure applicator that exerts a third predetermined pressure on the localized area, heated by the third thermal heater, such that only the third type of split-tube element, included in the localized area, is deformed and spread-out to exhibit the fourth single-color.

Preferably, the image-recording apparatus further comprises a first cooling unit that cools the first type of deformed and spread-out element to a temperature below the first predetermined glass-transition temperature, a second cooling unit that cools the second type of deformed and spread-out element to a temperature below the second predetermined glass-transition temperature, and a third cooling unit that cools the third type of deformed and spread-out element to a temperature below the third predetermined glass-transition temperature.

In accordance with the third aspect of the present invention, there is further provided an image-erasing apparatus that erases a color image, developed and recorded by the image-recording apparatus according to the third aspect of the present invention, on the image-developing layer of the image-recording substrate, comprising a thermal heater that heats the image-recording substrate to a temperature beyond the first, second and third predetermined glass-transition temperatures.

BRIEF DESCRIPTION OF THE DRAWINGS

These object and other objects of the present invention will be better understood from the following description, with reference to the accompanying drawings in which.

DESCRIPTION OF THE PREFERRED EMBODIMENTS

Figure 1:
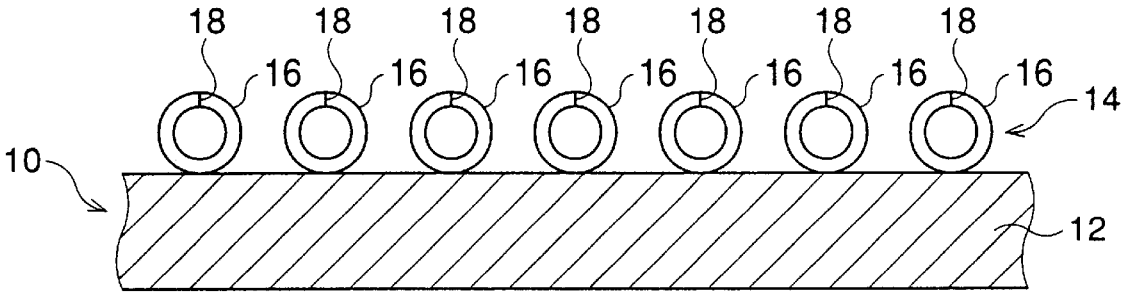
FIG. 1 is a schematic conceptual cross-sectional view showing a first embodiment of an image-recording substrate, according to the present invention, coated with an image-developing layer composed of a plurality of split-tube elements.

FIG. 1 shows a first embodiment of a rewriteable image-recording substrate, generally indicated by reference 10, which is constituted in accordance with the present invention. The image-recording substrate 10 is produced in a form of a paper sheet. Namely, the image-forming substrate or sheet 10 comprises a sheet of paper 12, and an image-developing layer 14 formed over a surface of the paper sheet 12. The image-developing layer 14 is formed of a plurality of split-tube elements 16 securely adhered to the paper sheet 12. In this embodiment, the split-tube elements 16 are regularly oriented and uniformly arranged over the surface of the paper sheet 12.

Figure 2:
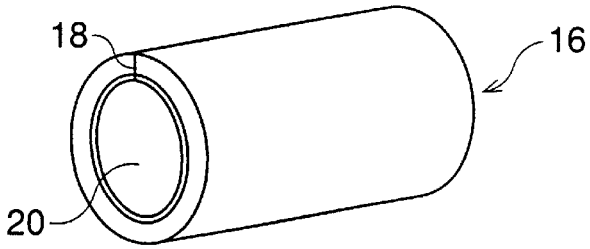
FIG. 2 is an enlarged schematic perspective view representatively showing one of the split-tube elements forming the image-developing layer of the image-recording substrate shown in FIG. 1.

As best shown in FIG. 2, each of the split-tube elements 16 has a split 18 formed along a central axis thereof, and the adhesion of each split-tube element 16 to the paper sheet 12 is performed such that the split 18 of the split-tube element 16 is oriented away from the surface of the paper sheet 12, as shown in FIG. 1. In each of the split-tube elements 16, an outer peripheral surface thereof is colored white, which is a same color as the paper sheet 12. Accordingly, if the paper sheet 12 is colored with a single color pigment, the outer peripheral surface of the split-tube element 16 may also be colored by the single color pigment. On the other hand, an inner cylindrical surface of the split-tube element 16 is colored or coated with a single-color pigment, different from the single-color of the outer peripheral surface thereof, which may be, for example, a black pigment, as indicated by reference numeral 20 in FIG. 2.

Each of the split-tube elements 16 per se is formed of a suitable shape memory resin. For example, the shape memory resin is represented by a polyurethane-based-resin, such as polynorbornene, trans-1,4-polyisoprene polyurethane. As other types of shape memory resin, a polyimide-based resin, a polyamide-based resin, a polyvinyl-chloride-based resin, a polyester-based resin and so on are also known.

Figure 3:
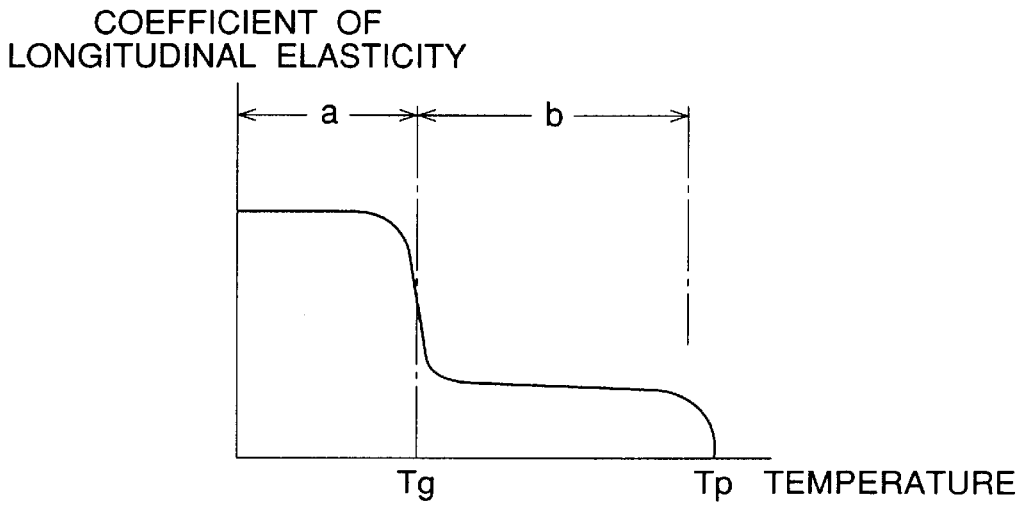
FIG. 3 is a graph showing a characteristic curve of a longitudinal elasticity coefficient of a shape memory resin from which the split-tube elements are formed.

In general, as shown in a graph of FIG. 3, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is below the glass-transition temperature $T_g$, and thus the shape memory resin exhibits a glass-like phase. On the other hand, Brownian movement of the molecular chains becomes increasingly energetic in a high-temperature area "b", which is above the glass-transition temperature $T_g$, and thus the shape memory resin exhibits a rubber elasticity. When the shape memory resin is heated to a plasticizing-temperature $T_p$, the coefficient of longitudinal elasticity becomes substantially zero, i.e. the shape memory resin is thermally plasticized or fused.

The shape memory resin is named due to the following shape memory characteristic:

A mass of the shape memory resin is worked into a shaped article in the low-temperature area "a". Alternatively, the shape memory resin is shaped into an article at a temperature somewhat higher than the plasticizing-temperature $T_p$, and is then cooled to a temperature lower than the glass-transition temperature $T_g$. Thereafter, when the shaped article is heated to beyond the glass-transition temperature $T_g$, the article becomes freely deformable. After the shaped article is deformed into another shape, and cooled to below the glass-transition temperature $T_g$, the most recent shape of the article is fixed and maintained. Nevertheless, when the deformed article is again heated to above the glass-transition temperature $T_g$, without being subjected to any load or external force, the deformed article returns to the original shape.

Note, for example, as a shape memory resin exhibiting a glass-transition temperature $T_g$ of 70° C. and a plasticizing-temperature $T_p$ of 150° C., a polyurethane-based shape memory resin is available.

The split-tube elements 16 may be produced using an extruder. In particular, first, the shape memory resin is heated to a temperature higher than the plasticizing-temperature $T_p$, and is extruded by the extruder to form an elongated tubular article, having a split formed along a central longitudinal axis thereof. Note, it is possible to extrude the tubular article having the split by suitably producing an extrusion die used in the extruder. After the extruded tubular article is cooled to below the glass-transition temperature $T_g$, an outer peripheral surface of the article is colored white, and an inner cylindrical surface thereof is colored black. Then, the extruded tubular article is cut into segments, having a given length, resulting in the production of the split-tube elements 16.

Of course, when the shape memory resin per se is colored with a white pigment, only the inner cylindrical surface of the extruded tubular article is colored black. Also, when the shape memory resin per se is colored black, only the outer peripheral surface of the extruded tubular article is colored white.

A diametrical size of the split-tube elements 16 may be suitably selected in accordance with an application of the image-developing substrate 10. When it is necessary to give the split-tube elements 16 a diametrically small size, which cannot be obtained by a conventional extruder, the extrusion of the tubular article is extended, with the plasticizing-temperature $T_p$ being maintained, whereby it is possible to reduce a diameter of the extruded tubular article to the desired diametrically small size.

When a localized area of the image-developing layer 14 is heated beyond the glass-transition temperature $T_g$, the split-tube elements 16 included in the localized area exhibit a rubber elasticity, so that they become easily deformable. Accordingly, if the easily-deformable split-tube elements 16 are subjected to a given deforming-pressure, each split-tube element 16 is spread out due to the existence of the split 18, as indicated by references 16' in FIG. 4. Of course, the spread-out elements 16' exhibit black, and, if the spread-out elements 16' are cooled to below the glass-transition temperature $T_g$, a shape of the spread-out elements 16' are fixed and maintained due to the property of the shape memory resin.

In short, by suitably controlling a heating-temperature and a deforming-pressure, which should be exerted on the image-recording sheet 10, it is possible to record and form an image on the image-developing layer 14 thereof. Note, it is possible to suitably determine the deforming-pressure in accordance with a thickness of the split-tube elements 16.

After the formation of the image on the image-developing layer 14 of the image-recording sheet 10, it is possible to erase the image therefrom by heating the image-recording sheet 10 to the glass-transition temperature $T_g$, because the spread-out elements 16' return to the original shape of the split-tube elements 16 due to the shape-transition property of the shape memory resin. Of course, the image-recording sheet 10, from which the image is erased, can be used to record and form an image thereon, if necessary. Namely, it is possible to repeatedly use the same image-recording sheet 10 for a formation of an image.

Figure 5:
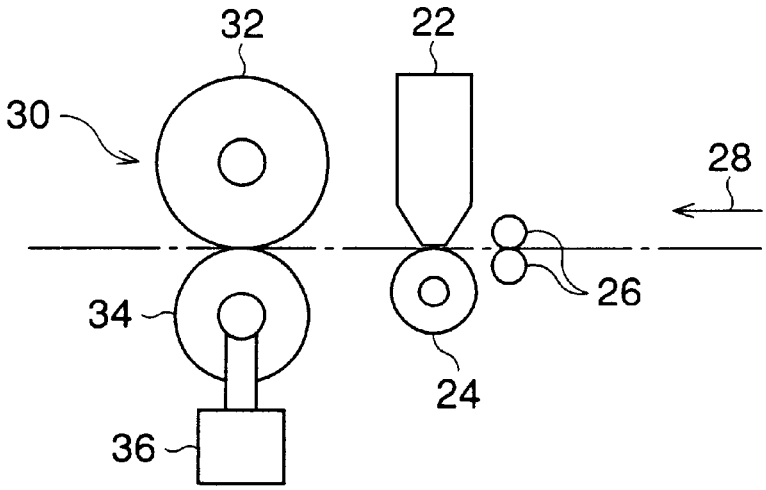
FIG. 5 is a schematic view of an image-recording apparatus for developing and recording an image on the image-developing layer of the image-recording substrate shown in FIG. 1.

FIG. 5 schematically shows an image-recording apparatus, which is constituted as a line printer so as to record and form an image on the image-developing layer 14 of the image-recording sheet 10.

The printer comprises a line thermal head 22 having a plurality of electric resistance elements aligned with each other, and a roller platen 24 resiliently pressed against the alignment of the electric resistance elements of the thermal head 22 at a given deforming-pressure. Each of the electric resistance elements of the thermal head 22 is selectively and electrically energized in accordance with a corresponding digital image-pixel signal in a manner as stated in detail hereinafter.

Note, in this embodiment, a localized area to be heated by each of the electric resistance elements of the thermal head 22 corresponds to one of the regularly oriented and uniformly arranged split-tube elements 16 forming the image-developing layer 14. Namely, a size of each split-tube element 16 substantially coincides with a size of the localized area heated by each of the electric resistance elements of the thermal head 22.

The printer is provided with a pair of register rollers 26, which partially defines a path of movement of the image-recording sheet 10, shown by a single-chained line in FIG. 5. During a recording operation, the image-recording sheet 10 is moved to the pair of register rollers 26 in a direction indicated by an arrow 28 in FIG. 5. When a leading edge of the image-recording sheet 10 abuts a nip between the register rollers 26, the image-recording sheet 10 is once stopped. When an initialization for an electrical energization of the thermal head 22 based on a series of digital image-pixel signals is completed, the register roller 26 are rotationally driven, so that the image-recording sheet 10 is introduced between the thermal head 22 and the roller platen 24.

Note, a feeding of the image-recording sheet 10 into the printer is carried out such that the image-developing layer 14 comes into contact with the thermal head 22.

During a passage of the image-recording sheet 10 between the thermal head 22 and the roller platen 24, the electric resistance elements of the thermal head 22 are selectively and electrically energized in accordance with the series of digital image-pixels. Whenever one of the electric resistance elements of the thermal head 22 is electrically energized, the electric resistance element concerned is heated to beyond the glass-transition temperature $T_g$. Thus, the split-tube element 16 heated by the electric resistance element concerned exhibits a rubber elasticity. At the moment of heating, the heated split-tube element 16 is also subjected to a given pressure by the roller platen 24, resiliently pressed against the thermal head 22, whereby the heated split-tube elements 16 in a localized area is spread out, as indicated by reference 16' in FIG. 4, resulting in a production of a black area on the image-developing layer 14, due to the spread-out elements 16' exhibiting black.

In short, while the image-recording sheet 10 passes between the thermal head 22 and the roller platen 24, an image is developed and formed on the image-developing layer 14 of the image-recording sheet 10 in accordance with the series of digital image-pixel signals. Thus, when the image-recording sheet 10 is discharged from between the thermal head 22 and the roller platen 24, the image-recording sheet 10 carries the image, which is produced by a contrast resulting from a combination of the unheated split-tube elements 16, exhibiting white, and the spread-out elements 16', exhibiting black.

The printer is also provided with a cooling unit 30 including a cooling roller 32 formed of a suitable metal material, such as aluminum, exhibiting a high thermal conductivity, a back-up roller 34 formed of, for example, a suitable hard rubber material, and a spring device 36 for resiliently pressing the back-up roller 34 against the cooling roller 32. The cooling roller 32 has a relatively large size so as to exhibit a sufficient thermal capacity and a thermal radiation effect.

The image-recording sheet 10 carrying the recorded image is introduced to a nip between the cooling roller 32 and the back-up roller 34, and thus the spread-out elements 16' are cooled to below the glass-transition temperature $T_g$ by contacting the cooling roller 32 under the pressure exerted by the back-up roller 34, whereby the shape of the spread-out elements 16' is fixed and maintained, i.e. the recorded image, developed on the image-developing layer 14, is securely fixed.

Similar to a conventional thermal head, the electric resistance elements of the thermal head 22 are embedded in a material exhibiting a good thermal conductivity, which forms a part of the thermal head 22. Thus, after the electrical energization of an electric resistance element of the thermal head 22 is completed, the electrical resistance element concerned is quickly cooled, whereby the heated and spread-out elements 16' may also be cooled to below the glass-transition temperature $T_g$, so that the shape of the spread-out elements 16' can be fixed and maintained. Accordingly, the cooling unit 30 may be omitted from the printer shown in FIG. 5, if necessary. Nevertheless, preferably, the printer is provided with the cooling unit 30 to ensure the secure fixing of the shape of the spread-out elements 16'.

Figure 6:
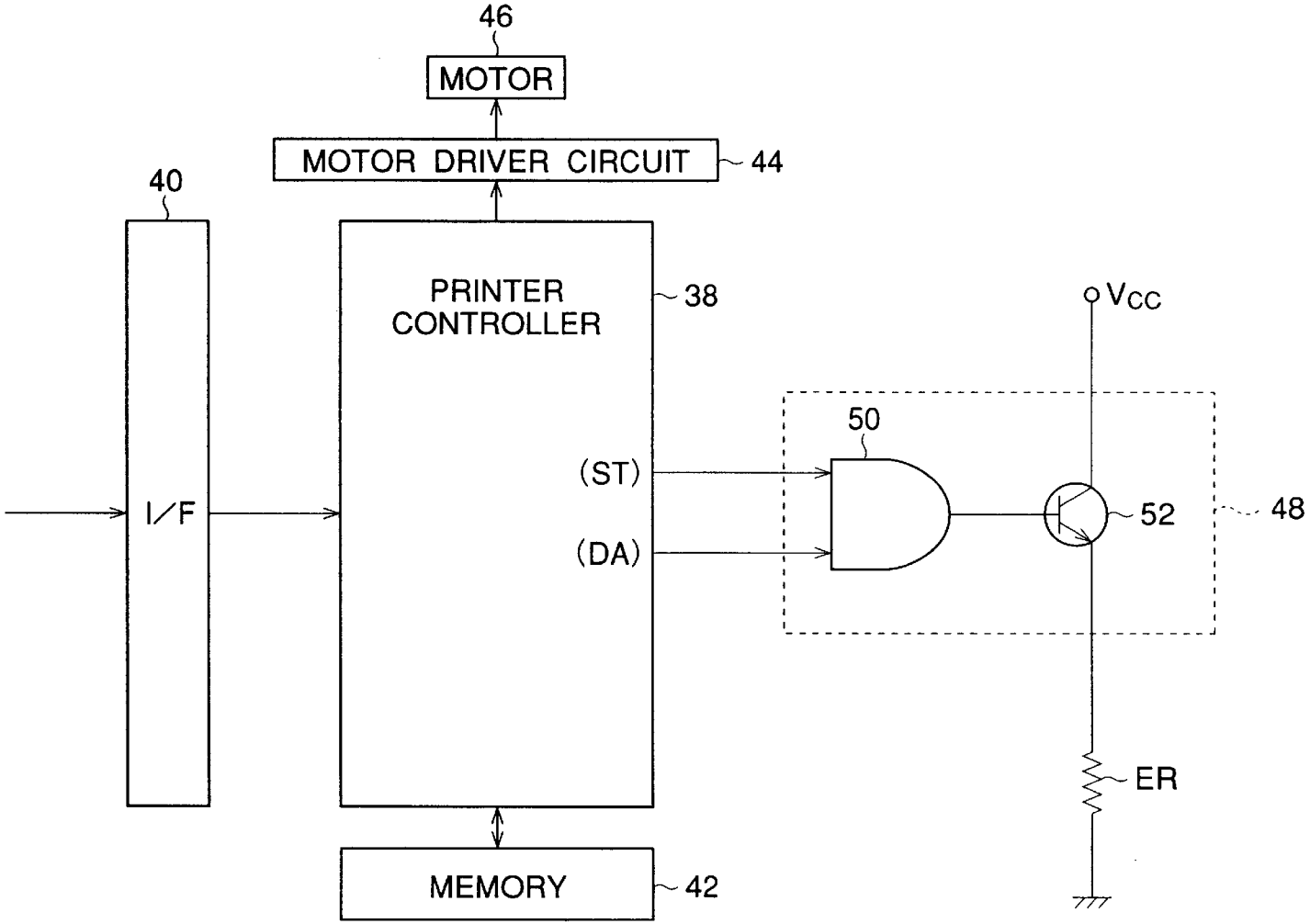
FIG. 6 is a partial schematic block diagram of a control circuit for the image-recording apparatus shown in FIG. 5.

FIG. 6 shows a part of a schematic block diagram of a control circuit for the printer shown in FIG. 5. The control circuit is provided with a printer controller 38 including a microcomputer. The printer controller 38 receives a series of digital image-pixel signals from a personal computer or a word processor (not shown) through an interface circuit (I/F)

40. The received digital image-pixel signals are once stored in a memory 42. Also, the control circuit is provided with a motor driver circuit 44 for driving a suitable electric motor 46, such as a stepping motor, a servo motor or the like, which is used to rotationally drive the roller platen 24 and the register rollers 26. The motor 46 is driven in accordance with a series of drive pulses outputted from the motor driver circuit 44, the outputting of the drive pulses from the motor drive circuit 44 to the motor 46 being controlled by the printer controller 38.

In FIG. 6, only one of the electric resistance elements, included in the line thermal head 22, is representatively illustrated, and is indicated by reference ER. The electric resistance element ER is selectively and electrically energized by a drive circuit 48 under control of the printer controller 38. The driver circuit 48 includes an AND-gate circuit 50 and a transistor 52. As shown in FIG. 6, a set of a strobe signal "ST" and a control signal "DA" is inputted from the printer controller 38 to two input terminals of the AND-gate circuit 50. A base of the transistor 52 is connected to an output terminal of the AND-gate circuit 50; a collector of the transistor 52 is connected to an electric power source ($V_{cc}$); and an emitter of the transistor 52 is connected to the electric resistance element ER.

Figure 7:
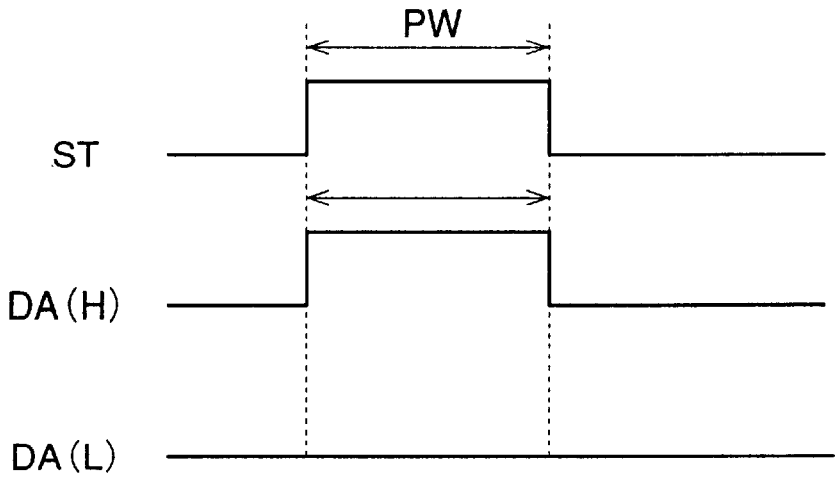
FIG. 7 is a timing chart showing a strobe signal and a control signal of electronically actuating a thermal head driver circuit for a line thermal head in the image-recording apparatus shown in FIG. 5.

During a printing operation, a set of a strobe signal "ST" and a control signal "DA" is outputted from the printer controller 38 in accordance with a digital image-pixel signal, and is then inputted to the input terminals of the AND-gate circuit 50. As shown in a timing chart of FIG. 7, the strobe signal "ST" has a pulse width "PW", and the control signal "DA" is varied in accordance with binary values of the digital image-pixel signal.

In particular, when a digital image-pixel signal has a value "0", the control signal "DA" is maintained at a low-level under control of the printer controller 38, and thus a corresponding electric resistance element ER is not electrically energized. When the digital image-pixel signal has a value "1", the control signal "DA" is outputted as a high-level pulse from the printer controller 38, and a pulse width of the high-level pulse has the same pulse width as the pulse width "PW" of the strobe signal "ST". Thus, a corresponding electric resistance element ER is electrically energized during a period corresponding to the pulse width "PW" of the high-level pulse of the control signal "DA", whereby the electric resistance element ER is heated to beyond the glass-transition temperature $T_g$. Accordingly, as mentioned above, the split-tube element 16, heated by the electrically-energized electric resistance element is spread out, resulting in a production of a black area on the image-developing layer 14, due to the spread-out element 16' exhibiting black.

Note, in the above-mentioned embodiment of the printer or image-recording apparatus, although the size of each split-tube element 16 substantially coincides with the size of the localized area heated by each of the electric resistance elements of the thermal head 22, each of the split-tube elements 16 may have a smaller size so that a plurality of the split-tube elements 16 are included in the localized area heated by each of the electric resistance elements of the thermal head 22.

Figure 8:
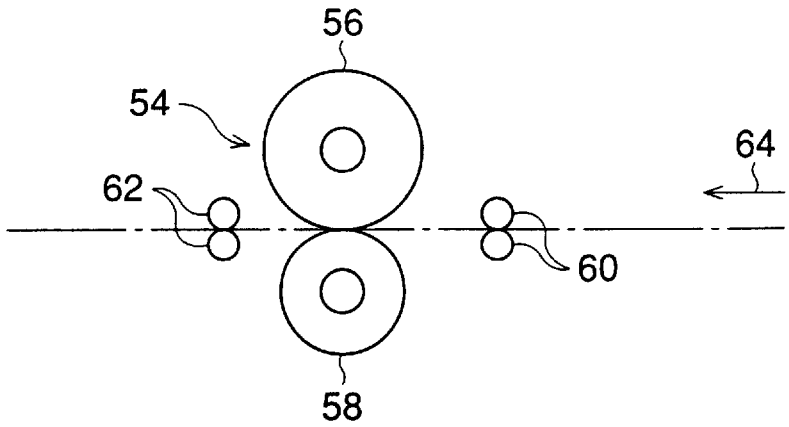
FIG. 8 is a schematic view of an image-erasing apparatus for erasing a developed and recorded image from the image-developing layer of the image-recording substrate shown in FIG. 1.

FIG. 8 schematically shows an image-erasing apparatus for erasing the recorded image from the image-developing layer 14 of the image-recording sheet 10.

The image-erasing apparatus comprises a heating unit 54 including a heat roller 56 formed as a hollow drum and having a heat source, such as an electric heater, housed therein, and a back-up roller 58 suitably associated with the heat roller 56. The hollow heat roller 56 is formed of a suitable metal material, such as aluminum, exhibiting a high thermal conductivity, and the back-up roller 58 is preferably formed of a heat-resistant rubber material, such as silicon rubber. During an image-erasing operation, the heat roller 56 is heated by the electric heater to beyond the glass-transition temperature $T_g$.

The image-erasing apparatus is provided with two pairs of feed rollers 60 and 62 provided at sides thereof, and the two pairs of feed rollers 60 and 62 define a path of movement of the image-recording sheet 10 carrying the recorded image, shown by a single-chained line in FIG. 8. During the image-erasing operation, the image-recording sheet 10 carrying the recorded image is introduced to a nip between the heat roller 56 and the back-up roller 58 through the pair of feed rollers 60, in a direction designated by an arrow 64 in FIG. 8.

Note, the introduction of the image-recording sheet 10 into the image-erasing apparatus is carried out such that the image-developing layer 14 comes into contact with the heat roller 56.

While the image-recording sheet 10 carrying the recorded image passes between the heat roller 56 and the back-up roller 58, the image-developing layer 14 of the image-recording sheet 10 is heated by the heat roller 56 to beyond the glass-transition temperature $T_g$. Once the spread-out elements 16', heated by the heat roller 56, has passed between the heat roller 56 and the back-up roller 58, the spread-out elements 16' are released from a pressing-force exerted thereon by the heat roll 56 and the back-up roller 58, whereby the spread-out elements 16' return to the original shape of the split-tube element 16, due to the shape-transition property of the shape memory resin. Thus, once the image-recording sheet 10 has completely passed through the heat roller 56 and the back-up roller 58, the erasing of the recorded image from the image-recording sheet 10 is achieved.

Of course, the image-recording sheet 10, from which the recorded image is erased, is discharged form the image-erasing apparatus through the pair of feed rollers 62, and is then reusable for recording an image thereon.

In the embodiment of the image-erasing apparatus shown in FIG. 8, a heat source lamp, such as a halogen lamp, may be substituted for the heat roller 56. In this case, as it is possible to directly irradiate the image-recording sheet 10 with heating-lights, emitted from the heat source lamp, the image-recording sheet 10 can be heated to beyond the glass-transition temperature $T_g$, without being subjected to any external forces.

Note, it is possible to utilize the image-recording apparatus, as shown in FIG. 5, as an image-erasing apparatus. In this case, the cooling roller 32 and the back up roller 34 of the cooling unit 30 are retracted from the path of the movement of the image-recording sheet 10, and all of the electric resistance elements of the thermal head 22 are electrically energized and heated to beyond the glass-transition temperature $T_g$ during the passage of the image-recording sheet 10 between the thermal head 22 and the roller platen 24.

Figure 9:
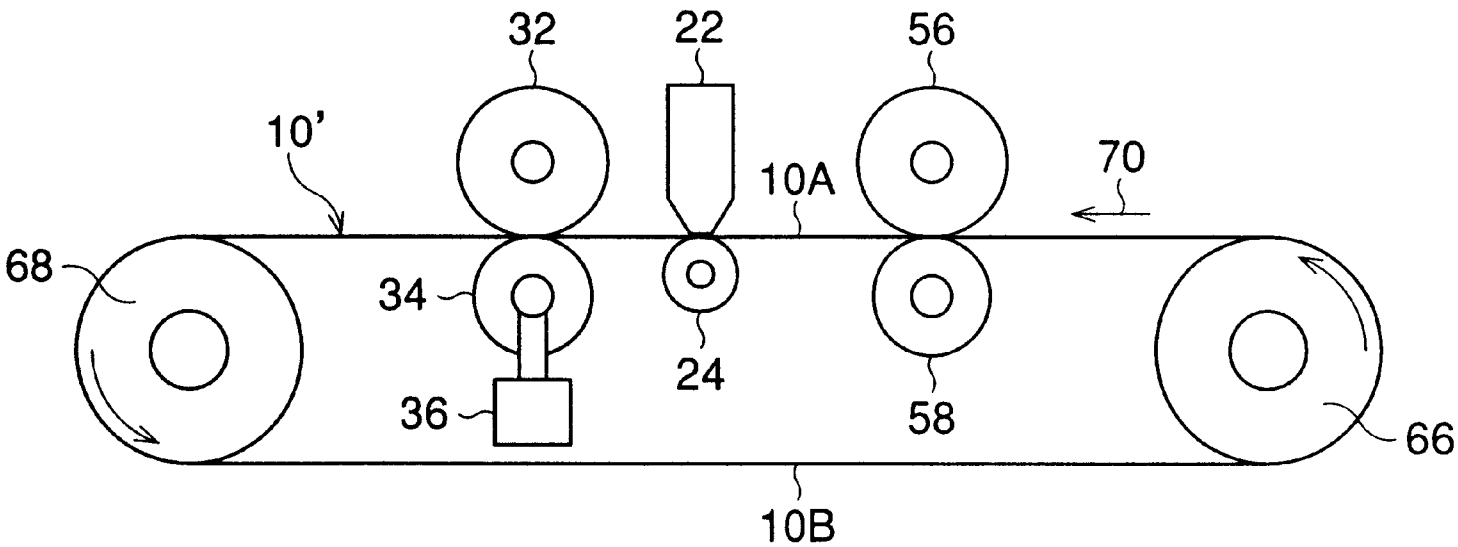
FIG. 9 is a schematic view showing a display system as an example of an application of the present invention, in which an endless-belt type of image-recording substrate, the image-recording apparatus shown in FIG. 5, and the image-erasing apparatus shown in FIG. 8 are utilized.

FIG. 9 schematically shows a display system as an example of an application of the present invention. In this display system, an endless-belt type of image-recording substrate 10' is utilized, and comprises an endless-belt formed of a suitable flexible reinforced composite material, and an image-developing layer (14) formed over an outer peripheral surface thereof. Of course, the image-developing layer (14) is formed of a plurality of split-tube elements (16) securely adhered to the outer peripheral surface of the endless-belt, and the split-tube elements (16) are regularly oriented and uniformly arranged over the outer peripheral surface of the endless-belt.

As shown in FIG. 9, the endless-type of image-recording substrate 10' is entrained with a pair of drums 66 and 68, which serve as a drive drum and a driven drum, respectively. The drive drum 66 is operationally connected to and rotationally driven by a suitable electric drive motor (not shown), such that the endless-type of image-recording substrate 10' runs in a direction indicated by an arrow 70 in FIG. 9.

The endless-belt type of image-recording substrate 10' provides two running sections 10A and 10B between the drums 66 and 68. As shown in FIG. 9, an image-recording apparatus, as shown in FIG. 5, and an image-erasing apparatus, as shown in FIG. 8, are arranged along the running section 10A of the endless-belt type of image-recording substrate 10'. Note, in FIG. 9, the features similar to those of FIG. 5 are indicated by the same reference numerals, and the feature similar to those of FIG. 8 are indicated by the same reference numerals. On the other hand, the running section 10B serves as a display area, as stated hereinafter.

As is apparent form FIG. 9, in the running direction of the endless-belt type of image-recording substrate 10', the image-recording apparatus (FIG. 5) is placed along the running section 10A downstream of the image-erasing apparatus (FIG. 8). By the image-recording apparatus (FIG. 5), images, which may include character information, are successively written in the image-developing layer (14) of the endless-belt type of image-recording substrate 10' in accordance with a series of digital image-pixel signals, and are then displayed in the running section 10B. Thereafter, the displayed images are erased from the image-developing layer (14) by the image-erasing apparatus (FIG. 8), and the erased area, from which the displayed images are erased, is again fed to the image-recording apparatus (FIG. 5) for writing further images.

For example, when the display system (FIG. 9) is installed at an outdoor place, a baseball field, a soccer field or the like, the split-tube elements (16) may have a diametrical size of more than several centimeters. On the other hand, when the display system (FIG. 9) is installed in a shopwindow for the purpose of, for example, advertisement, the split-tube elements (16) may have a diametrical size of less than several millimeters.

Figure 10:
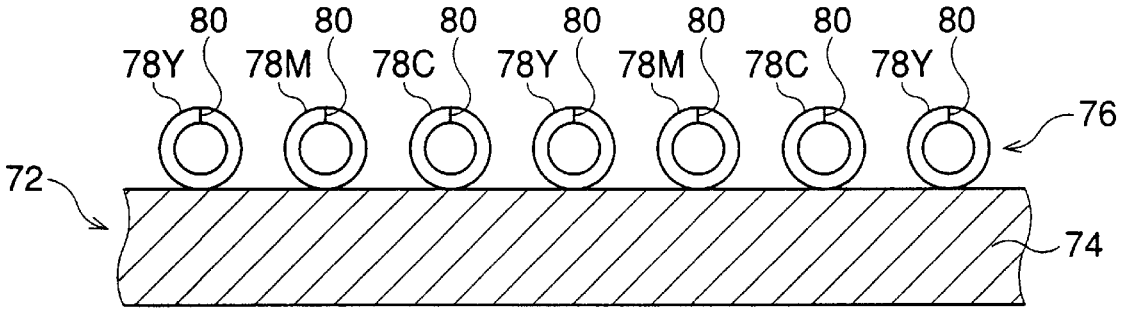
FIG. 10 is a schematic conceptual cross-sectional view showing a second embodiment of an image-recording substrate, according to the present invention, coated with an image-developing layer composed of a plurality of split-tube elements including a first type of split-tube element, a second type of split-tube element and a third type of split-tube element.

FIG. 10 shows a second embodiment of a rewriteable color-image-recording substrate, generally indicated by reference 72, which is constituted in accordance with the present invention. The color-image-recording substrate 72 is produced in a form of a paper sheet. Namely, the color-image-forming substrate or sheet 72 comprises a sheet of paper 74, and an image-developing layer 76 formed over a surface of the paper sheet 74. The image-developing layer 76 is formed from three types of split-tube elements: a first type of split-tube elements 78Y, a second type of split-tube elements 78M, and a third type of split-tube element 78C. Similar to the first embodiment, each type of split-tube elements (78Y, 78M, 78C) has a split 80 formed along a central axis thereof, and is securely adhered to the paper sheet 74 such that the split 80 of each slit-tube element (78Y, 78M, 78C) is oriented away from the surface of the paper sheet 74, as shown in FIG. 10.

In each type of split-tube elements (78Y, 78M, 78C), an outer peripheral surface thereof is usually colored white, which is the same color as the paper sheet 74. However, an inner cylindrical surface of the first type of split-tube elements 78Y is colored or coated with yellow pigment; an inner cylindrical surface of the second type of split-tube elements 78M is colored or coated with magenta pigment; and an inner cylindrical surface of the third type of split-tube elements 78C is colored or coated with cyan pigment.

Figure 11:
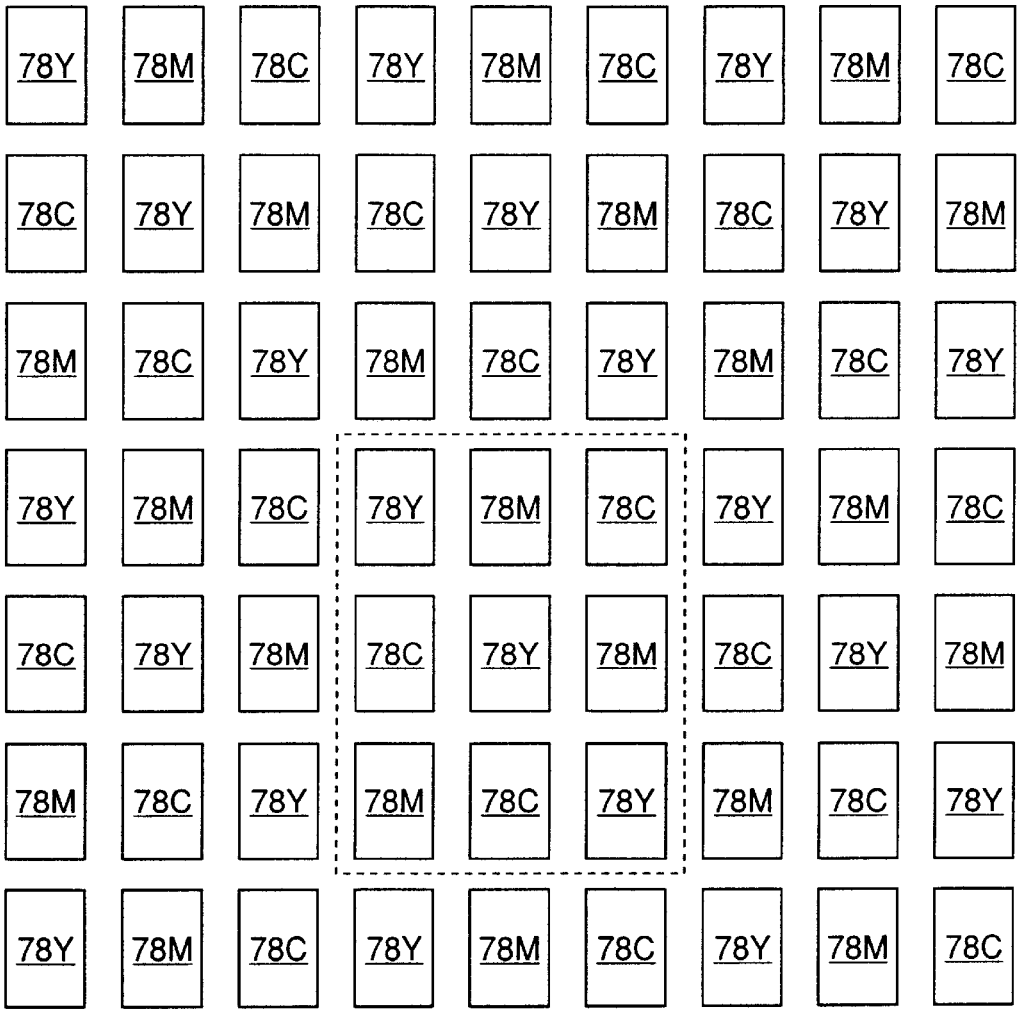
FIG. 11 is a conceptual view showing a regular and uniform arrangement of the first, second and third types of split-tube elements in the image-developing layer of the image-recording substrate shown in FIG. 10.

As shown in FIG. 11, the three types of split-tube element 78Y, 78M and 78C are regularly and uniformly oriented and arranged over the surface of the paper sheet 74 to form the image-developing layer 76 such that, when a matrix-like-localized area including a number of split-tube elements (78Y, 78M, 78C), being a multiple of 3, is defined on the image-developing layer 76, the same numbers of yellow, magenta and cyan split-tube elements 78Y, 78M and 78C are included in the matrix-like-localized area. For example, when a 3×3 matrix-like-localized area including nine split-tube elements (78Y, 78M, 78C) is defined on the image-developing layer 76, as encompassed by dotted lines in FIG. 11, like numbers of yellow, magenta and cyan split-tube elements 78Y, 78M and 78C are included therein.

Similar to the first embodiment, for each type of split-tube elements (78Y, 78M, 78C), a shape memory resin is utilized with characteristic longitudinal elasticity coefficients that vary from each other. In particular, as shown in a graph of FIG. 12, a shape memory resin of the yellow split-tube elements 78Y is prepared so as to exhibit a characteristic longitudinal elasticity coefficient, indicated by a solid line 78Y', having a glass-transition temperature $T_1$; a shape memory resin of the magenta split-tube elements 78M is prepared so as to exhibit a characteristic longitudinal elasticity coefficient, indicated by a double-chained line 78M', having a glass-transition temperature $T_2$, and a shape memory resin of the cyan split-tube elements 78C is prepared so as to exhibit a characteristic longitudinal elasticity coefficient, indicated by a single-chained line 78C', having a glass-transition temperature $T_3$.

Figure 12:
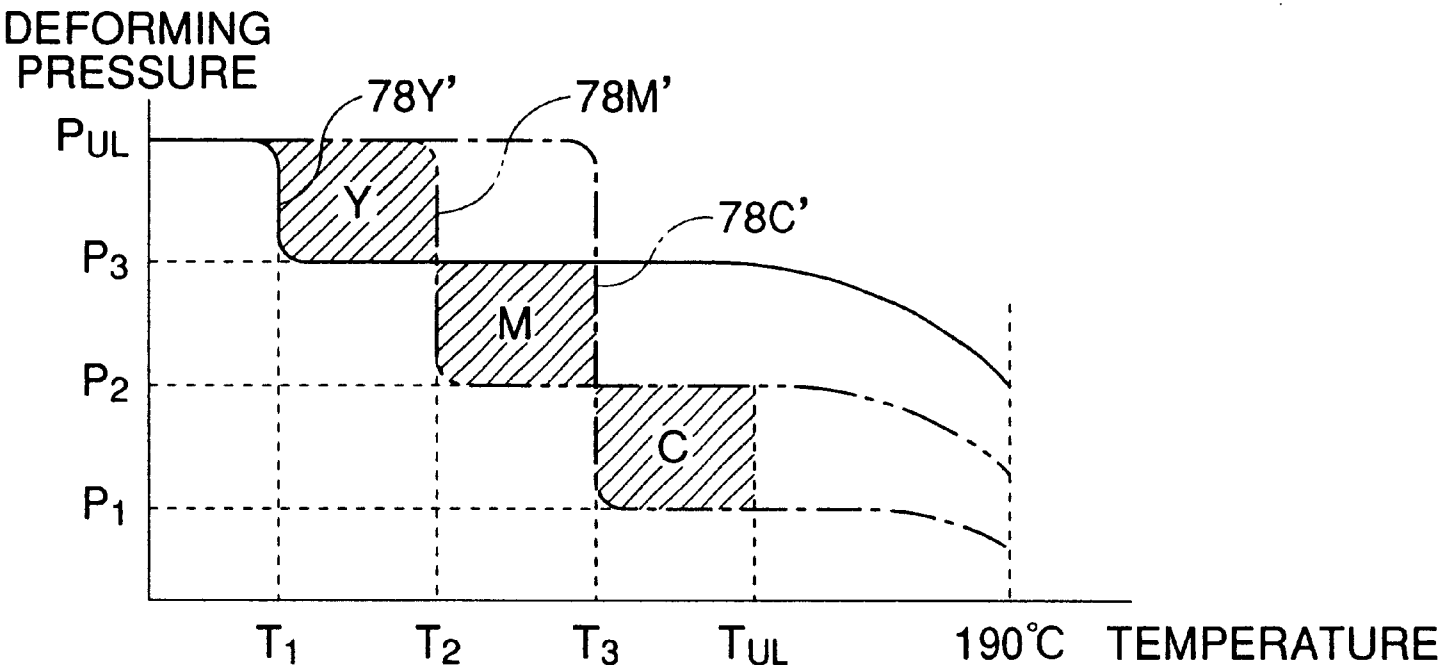
FIG. 12 is a graph showing a relationship between deforming-pressures and heating-temperatures for selectively deforming and spreading out the first, second and third types of split-tube elements, which are formed of first, second and third types of shape memory resins, respectively.

By suitably varying compositions of the shape memory resins and/or by selecting a suitable one from among various types of shape memory resin, it is possible to obtain the respective shape memory resins, with the glass-transition temperatures $T_1$, $T_2$ and $T_3$. For example, for the shape memory resin of the first type of split-tube elements 78Y, a polyurethane-based shape memory resin, exhibiting a glass-transition temperature of 70° C. ($T_1$), may be utilized; for the shape memory resin of the second type of split-tube elements 78M, a polyolefin-based shape memory resin, exhibiting a glass-transition temperature of 110° C. ($T_2$), may be utilized; and for the shape memory resin of the third type of split-tube elements 78C, another polyolefin-based shape memory resin, exhibiting a glass-transition temperature of 130° C. ($T_3$). Note, these shape memory resins can be sufficiently and thermally plasticized at a temperature of 190° C. (FIG. 12).

Also, similar to the first embodiment, each type of split-tube elements (78Y, 78M, 78C) may be produced by cutting an elongated tubular article extruded from a corresponding shape memory resin by using an extruder. Of course, while the elongated tubular article for each type of split-tube elements (78Y, 78M, 78C) is extruded, the corresponding shape memory resin is heated to a temperature of from about 150° C. to about 190° C.

Figure 4:
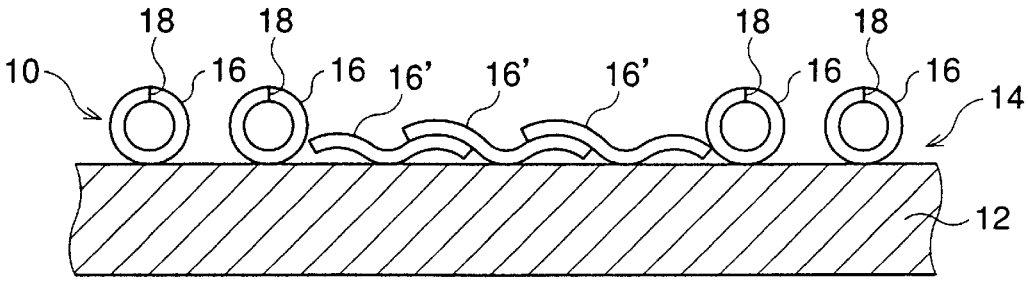
FIG. 4 is a schematic conceptual cross-sectional view, similar to FIG. 1, in which some of the split-tube elements are deformed and spread out.

The respective three types of split-tube elements 78Y, 78M and 78C differ in thickness such that each type of split-tube elements (78Y, 78M, 78C) can be easily deformed and spread out, as indicated by references 16' in FIG. 4, when subjected to a predetermined deforming-pressure at a heating-temperature beyond the corresponding glass-transition temperature ($T_1$, $T_2$, $T_3$).

In particular, the yellow split-tube elements 78Y are given a wall thickness such that each split-tube elements 78Y is easily deformed and spread out under a deforming-pressure that lies between a critical deforming-pressure $P_3$ and an upper limit pressure $P_{UL}$ (FIG. 12), when each split-tube element 78Y is heated to a temperature between the glass-transition temperatures $T_1$ and $T_2$; the magenta split-tube elements 78M are given a wall thickness such that each split-tube element 78M is easily deformed and spread out under a deforming-pressure that lies between critical deforming-pressures $P_2$ and $P_3$ (FIG. 12), when each split-tube element 78M is heated to a temperature between the glass-transition temperatures $T_2$ and $T_3$; and the cyan split-tube elements 78C are given a wall thickness such that each split-tube element 78C is easily deformed and spread out under a deforming-pressure that lies between critical deforming-pressures $P_1$ and $P_2$ (FIG. 12), when each split-tube element 78C is heated to a temperature between the glass-transition temperature $T_3$ and an upper limit temperature $T_{UL}$.

Note, for example, the pressures $P_1$, $P_2$, $P_3$ and $P_{UL}$ are set to 0.02, 0.2, 2.0 and 20 MPa, respectively, and the upper limit temperature $T_{UL}$ may be 150° C.

Thus, by suitably selecting a heating-temperature and a deforming-pressure, which should be exerted on the image-developing layer 76 of the color-image-recording sheet 72, it is possible to selectively deform and spread out the yellow, magenta and cyan split-tube elements 78Y, 78M and 78C.

For example, if the selected heating-temperature and deforming-pressure fall within a hatched yellow area Y (FIG. 12), defined by a temperature range between the glass-transition temperatures $T_1$ and $T_2$ and by a pressure range between the critical deforming-pressure $P_3$ and the upper limit pressure $P_{UL}$, only the yellow split-tube elements 78Y are deformed and spread out. Also, if the selected heating-temperature and deforming-pressure fall within a hatched magenta area M, defined by a temperature range between the glass-transition temperatures $T_2$ and $T_3$ and by a pressure range between the critical deforming-pressures $P_2$ and $P_3$, only the magenta split-tube elements 78M are deformed and spread out. Further, if the selected heating-temperature and deforming-pressure fall within a hatched cyan area C, defined by a temperature range between the glass-transition temperature $T_3$ and the upper limit temperature $T_{UL}$ and by a pressure range between the critical deforming-pressures $P_1$ and $P_2$, only the cyan split-tube elements 78C are deformed and spread out.

Thus, if the selection of a heating-temperature and a deforming-pressure, which should be exerted on the image-developing layer 76 of the color-image-recording sheet 72, are suitably controlled in accordance with digital color image-pixel signals: digital cyan image-pixel signals, digital magenta image-pixel signals and digital yellow image-pixel signals, it is possible to form a color image on the image-developing layer 76 on the basis of the digital color image-pixel signals.

Figure 13:
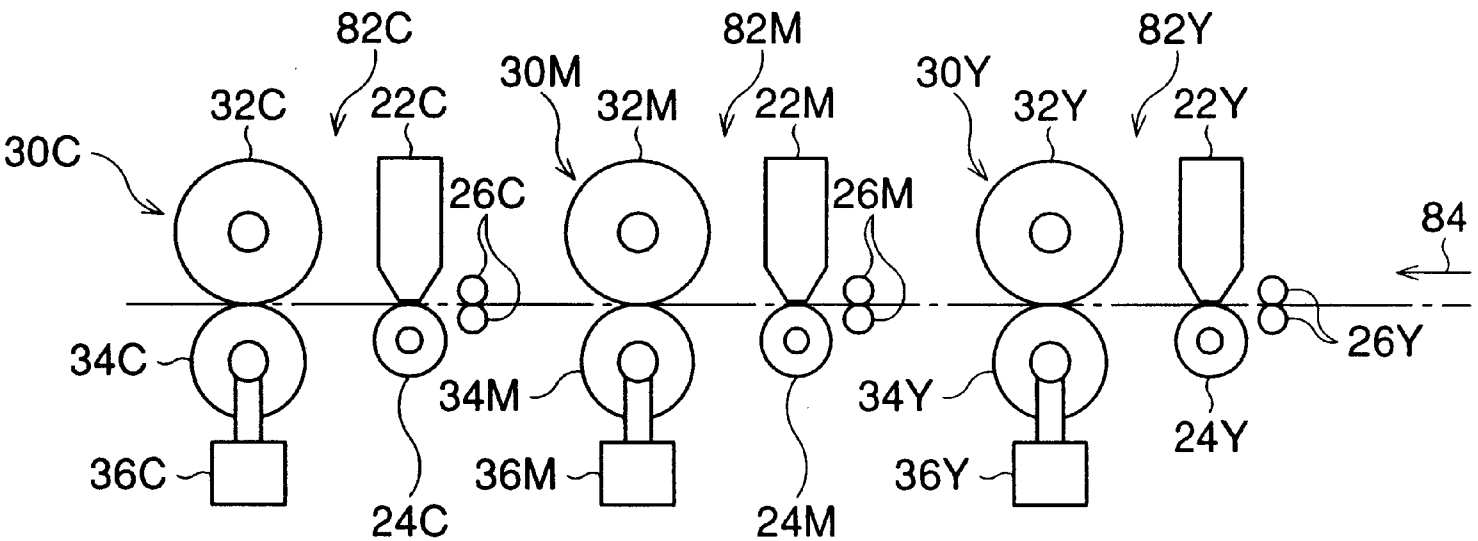
FIG. 13 is a schematic view of a color-image-recording apparatus for developing and recording a color image on the image-developing layer of the image-recording substrate shown in FIG. 10.

FIG. 13 schematically shows a color-image-recording apparatus, which is constituted as a line color printer so as to form a color image on the image-developing layer 76 of the color-image-recording sheet 72.

The color printer comprises first, second and third printing units 82Y, 82M and 82C successively arranged along a path of movement of the color-image-recording sheet 72, shown by a single-chained line in FIG. 13, and the color-image-recording sheet 72 is moved along the path in a direction indicated by an arrow 84 in FIG. 13, during a printing operation. Each of the printing units 82Y, 82M and 82C is substantially identical to the printer or image-recording apparatus shown in FIG. 5. Thus, in FIG. 13, the features of the printing unit 82Y, similar to those of FIG. 5, are indicated by the same reference numerals with an additional character "Y", the features of the printing unit 82M, similar to those of FIG. 5, are indicated by the same reference numerals with an additional character "M", and the features of the printing unit 82C, similar to those of FIG. 5, are indicated by the same reference numerals with an additional character "C".

The first printing unit 82Y is provided with a line thermal head 22Y including a plurality of electric resistance elements aligned with each other along a length of the line thermal heat 22Y, and a roller platen 24Y resiliently pressed against the alignment of the electric resistance elements of the thermal head 22Y at the pressure between the critical deforming-pressure $P_3$ and the upper limit pressure $P_{UL}$. Each of the electric resistance elements is selectively and electrically energized in accordance with a corresponding yellow image-pixel signal in a manner as stated in detail hereinafter.

The first printing unit 82Y is further provided with a cooling unit 30Y including a cooling roller 32Y formed of, for example, aluminum, a back-up roller 34Y formed of, for example, a suitable hard rubber material, and a spring device 36Y for resiliently pressing the back-up roller 34Y against the cooling roller 32Y at the pressure between the critical deforming-pressure $P_3$ and the upper limit pressure $P_{UL}$.

The second printing unit 82M is provided with a line thermal head 22M including a plurality of electric resistance elements aligned with each other along a length of the line thermal head 22M, and a roller platen 24M resiliently pressed against the alignment of the electric resistance elements of the thermal head 22M at the pressure between the critical deforming-pressures $P_2$ and $P_3$. Each of the electric resistance elements is selectively and electrically energized in accordance with a corresponding magenta image-pixel signal in a manner as stated in detail hereinafter.

The second printing unit 82M is further provided with a cooling unit 30M including a cooling roller 32M formed of, for example, aluminum, a back-up roller 34M formed of, for example, a suitable hard rubber material, and a spring device 36M for resiliently pressing the back-up roller 34M against the cooling roller 32M at the pressure between the critical deforming-pressures $P_2$ and $P_3$.

The third printing unit 82C is provided with a line thermal head 22C including a plurality of electric resistance elements aligned with each other along a length of the line thermal head 22C, and a roller platen 24C resiliently pressed against the alignment of the electric resistance elements of the thermal head 22C at the pressure between the critical deforming-pressures $P_1$ and $P_2$. Each of the electric resistance elements is selectively and electrically energized in accordance with a corresponding cyan image-pixel signal in a manner as stated in detail hereinafter.

The third printing unit 82C is further provided with a cooling unit 30C including a cooling roller 32C formed of, for example, aluminum, a back-up roller 34C formed of, for example, a suitable hard rubber material, and a spring device 36C for resiliently pressing the back-up roller 34C against the cooling roller 32C at the pressure between the critical deforming-pressures $P_1$ and $P_2$.

The first printing unit 82Y is provided with a pair of register rollers 26Y, which partially defines the path of movement of the color-image-recording sheet 72, shown by the single-chained line in FIG. 13. During a recording operation, the pair of register rollers 26Y functions in substantially the same manner as the pair of register rollers 26 shown in FIG. 5. Namely, when a leading edge of the color-image-recording sheet 72 abuts a nip between the register rollers 26Y, the color-image-recording sheet 72 is once stopped. When an initialization for an electrical energization of the thermal heads 22Y, 22M and 22C based on a series of digital color image-pixel signals is completed, the register rollers 26Y are rotationally drive, so that the image-recording sheet 72 is introduced into the first printing unit 82Y. Similarly, the second and third printing units 82M and 82C are provided with a pair of guide rollers (26M, 26C), and each pair of guide rollers (26M, 26C) serves as a pair of feeder rollers for introducing the color-image-recording sheet 72 to a corresponding printing unit (82M, 82C).

Note, of course, a feeding of the color-image-recording sheet 72 into the first, second and third printing units 82Y, 82M and 82C is carried out such that the color-image-developing layer 76 contacts each of the first, second and third thermal heads 22Y, 22M and 22C.

Note, in the second embodiment, each of the electric resistance elements, included in each of the thermal heads 22Y, 22M and 22C, is sized such that a localized heating-area to be heated by the electric resistance element concerned corresponds to a 3×3 matrix-like localized area, including nine split-tube elements (78Y, 78M, 78C), which is defined on the image-developing layer 76.

Figure 14:
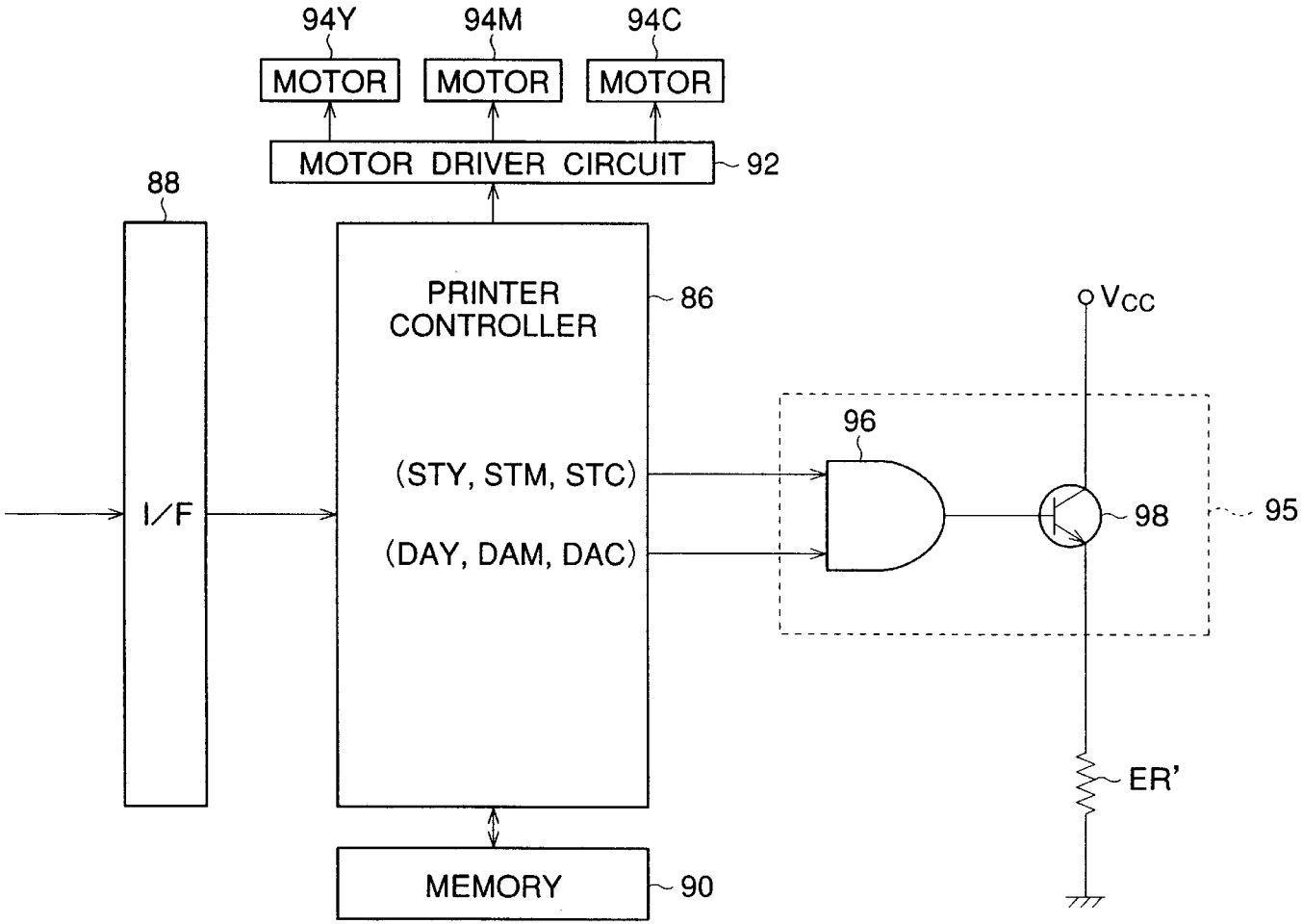
FIG. 14 is a partial schematic block diagram of a control circuit for the color-image-recording apparatus shown in FIG. 13.

FIG. 14 shows a part of a schematic block diagram of a control circuit for the color printer shown in FIG. 13. The control circuit is provided with a printer controller 86 including a microcomputer. The printer controller 86 receives a series of digital color image-pixel signals from a personal computer or a word processor (not shown) through an interface circuit (I/F) 88. The received digital image-pixel signals are once stored in a memory 90. Also, the control circuit is provided with a motor driver circuit 92 for driving electric motors 94Y, 94M and 94C, which are used to rotationally drive the roller platens 24Y, 24M and 24C and the register rollers 26Y, and the guide rollers 26M, 26C, respectively. Each of the motors 94Y, 94M and 94C may be a stepping motor, a servo motor or the like, and is driven in accordance with a series of drive pulses outputted from the motor driver circuit 92, with the outputting of the drive pulses from the motor driver circuit 92 to each of the motors 94Y, 94M and 94C being controlled by the printer controller 86.

In FIG. 14, only one of the electric resistance elements, included in each of the line thermal heads 22Y, 22M and 22C is representatively illustrated, and is indicated by reference ER'. The electric resistance element ER' is selectively and electrically energized by a driver circuit 95 under control of the printer controller 86. The driver circuit 95 includes an AND-gate circuit 96 and a transistor 98. As shown in FIG. 14, a set of a strobe signal ("STY", "STM", "STC") and a control signal ("DAY", "DAM", "DAC") is inputted from the printer controller 86 to two input terminals of the AND-gate circuit 96. A base of the transistor 98 is connected to an output terminal of the AND-gate circuit 96; a collector of the transistor 98 is connected to an electric power source ($V_{cc}$); and an emitter of the transistor 98 is connected to the electric resistance element ER'.

Figure 15:
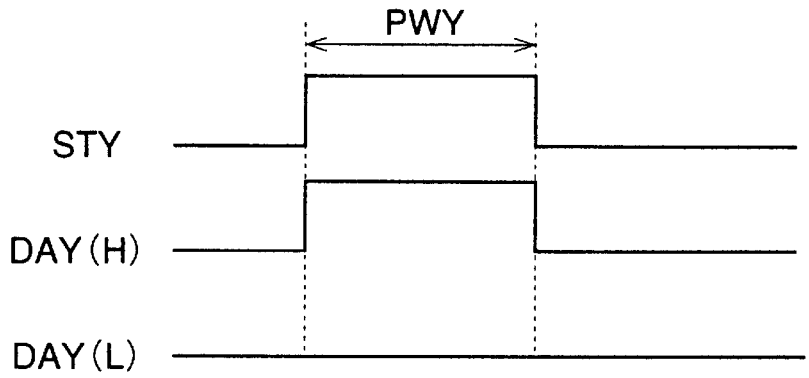
FIG. 15 is a timing chart showing a strobe signal and a control signal for electronically actuating a thermal head driver circuit of a first line thermal head in the color-image-recording apparatus shown in FIG. 13.

When the electric resistance element ER', as shown in FIG. 14, is one included in the first thermal head 22Y, a set of a strobe signal "STY" and a control signal "DAY" is outputted from the printer controller 86, and is then inputted to the input terminals of the AND-gate circuit 96, during a printing operation. As shown in a timing chart of FIG. 15, the strobe signal "STY" has a pulse width "PWY", and the control signal "DAY" is varied in accordance with binary values of a digital yellow image-pixel signal.

In particular, when a digital yellow image-pixel signal has a value "0", the control signal "DAY" is maintained at a low-level under control of the printer controller 86, and thus a corresponding electric resistance element ER', included in the first thermal head 22Y, is not electrically energized. When the digital yellow image-pixel signal has a value "1", the control signal "DAY" is outputted as a high-level pulse from the printer controller 86, and a pulse width of the high-level pulse has the same pulse width as the pulse width "PWY" of the strobe signal "STY".

Thus, a corresponding electric resistance element ER', included in the first thermal head 22Y, is electrically energized during a period corresponding to the pulse width "PWY" of the high-level pulse of the control signal "DAY", whereby the electric resistance element ER' is heated to the temperature between the glass-transition temperature $T_1$ and $T_2$. Accordingly, in a 3×3 matrix-like-localized area, defined on the color-image-recording sheet 72 by the electrically-energized electric resistance element ER', only the three split-tube elements 78Y are spread out, resulting in a production of a yellow area, corresponding to the 3×3 matrix-like-localized area, on the color-image-recording sheet 72.

Figure 16:
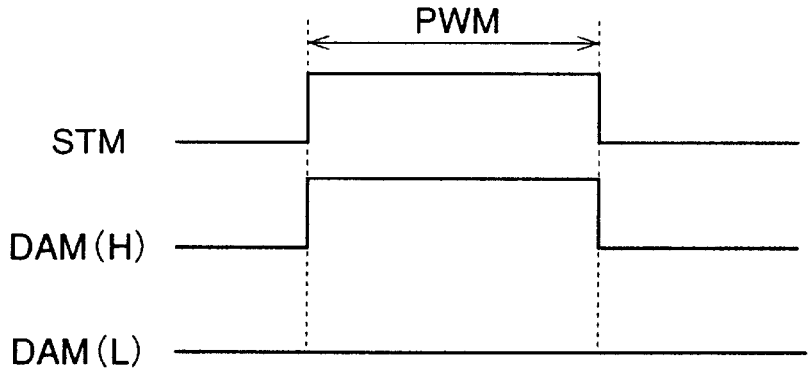
FIG. 16 is a timing chart showing a strobe signal and a control signal for electronically actuating a thermal head driver circuit of a second line thermal head in the color-image-recording apparatus shown in FIG. 13.

Further, when the electric resistance element ER', as shown in FIG. 14, is one included in the second thermal head 22M, a set of a strobe signal "STM" and a control signal "DAM" is outputted from the printer controller 86, and is then inputted to the input terminals of the AND-gate circuit 96, during a printing operation. As shown in a timing chart of FIG. 16, the strobe signal "STM" has a pulse width "PWM", and the control signal "DAM" is varied in accordance with binary values of a digital magenta image-pixel signal.

In particular, when a digital magenta image-pixel signal has a value "0", the control signal "DAM" is maintained at a low-level under control of the printer controller 86, and thus a corresponding electric resistance element ER', included in the second thermal head 22M, is not electrically energized. When the digital magenta image-pixel signal has a value "1", the control signal "DAM" is outputted as a high-level pulse from the printer controller 86, and a pulse width of a high-level pulse has the same pulse width as the pulse width "PWM" of the strobe signal "STM", which is longer than the pulse width "PWY" of the control signal "DAY".

Thus, a corresponding electric resistance element ER', included in the second thermal head 22M, is electrically energized during a period corresponding to the pulse width "PWM" of the high-level pulse of the control signal "DAM", whereby the electric resistance element ER' is heated to the temperature between the glass-transition temperatures $T_2$ and $T_3$. Accordingly, in a 3×3 matrix-like-localized area, defined on the color-image-recording sheet 72 by the electrically-energized electric resistance element ER', only the three split-tube elements 78M are spread out, resulting in a production of a magenta area, corresponding to the 3×3 matrix-like-localized area, on the color-image-recording sheet 72.

Figure 17:
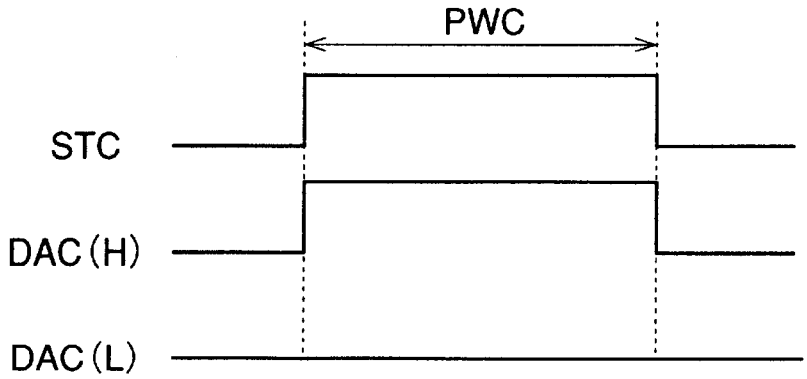
FIG. 17 is a timing chart showing a strobe signal and a control signal for electronically actuating a thermal head driver circuit of a third line thermal head in the color-image-recording apparatus shown in FIG. 13.

Also, when the electric resistance element ER', as shown in FIG. 14, is one included in the third thermal head 22C, a set of a strobe signal "STC" and a control signal "DAC" is outputted from the printer controller 86, and is then inputted to the input terminals of the AND-gate circuit 96, during a printing operation. As shown in a timing chart of FIG. 17, the strobe signal "STC" has a pulse width "PWC", and the control signal "DAC" is varied in accordance with binary values of a digital cyan image-pixel signal.

In particular, when a digital cyan image-pixel signal has a value "0", the control signal "DAC" is maintained at a low-level under control of the printer controller 86, and thus a corresponding electric resistance element ER', included in the third thermal head 22C, is not electrically energized. When the digital cyan image-pixel signal has a value "1", the control signal "DAC" is outputted as a high-level pulse from the printer controller 86, and a pulse width of the high-level pulse has the same pulse width as the pulse width "PWC" of the strobe signal "STC", which is longer than the pulse width "PWM" of the control signal "DAM".

Thus, a corresponding electric resistance element ER', included in the third thermal head 22C, is electrically energized during a period corresponding to the pulse width "PWC" of the high-level pulse of the control signal "DAC", whereby the electric resistance element ER' is heated to the temperature between the glass-transition temperature $T_3$ and the upper limit temperature $T_{UL}$. Accordingly, in a 3×3 matrix-like-localized area, defined on the color-image-recording sheet 72 by the electrically-energized electric resistance element ER', only the three split-tube elements 78C are spread out, resulting in a production of a cyan area, corresponding to the 3×3 matrix-like-localized area, on the color-image-recording sheet 72.

Of course, after a color image is formed on the color-image-recording sheet 72, it is possible to erase the color image from the color-image-recording sheet 72 by utilizing the image-erasing apparatus as shown in FIG. 8. Thus, the same color-image-recording sheet 72, from which the color image is erased, is reusable for recording a color image thereon.

Finally, it will be understood by those skilled in the art that the foregoing description is of preferred embodiments of the rewritable image-forming substrate, and that various changes and modifications may be made to the present invention without departing from the spirit and scope thereof.

The present disclosure relates to subject matters contained in Japanese Patent Application No. 10-84949 (filed on Mar. 16, 1998) which is expressly incorporated herein, by reference, in its entirety.

What is claimed is:

1. A rewriteable image-recording substrate comprising:

a base member; and an image-developing layer, that coats a surface of said base member, composed of a plurality of split-tube elements formed of a shape memory resin exhibiting a predetermined glass-transition temperature, wherein a split is formed along a central axis of each of said split-tube elements, and said each split-tube element is securely adhered to said surface of said base member such that said split is oriented away from said surface of said base member, an outer peripheral surface of said each split-tube element being colored with a first single-color, an inner cylindrical surface of said each split-tube element being colored with a second a single-color.

2. An image-recording substrate as set forth in claim 1, wherein said surface of said base member exhibits said first single-color.

3. An image-recording substrate as set forth in claim 2, wherein said first single-color is white, and said second single-color is black.

4. The rewritable image-recording substrate of claim 1, in combination with an image-recording apparatus that develops and records an image on said image-developing layer of said image-recording substrate, said image-recording apparatus comprising:

a thermal heater that selectively heats a localized area of said image-developing layer of said image-recording substrate to a temperature beyond said predetermined glass-transition temperature in accordance with image-pixel information; and a pressure applicator that exerts a predetermined pressure on said localized area, heated by said thermal heater, such that a split-tube element, included in said localized area, is deformed and spread out so as to exhibit said second single-color.

5. The combination of claim 4, wherein the image-recording apparatus further comprises a cooling unit that cools said deformed and spread-out element to a temperature below said predetermined glass-transition temperature.

6. The combination of claim 4, wherein said image-recording apparatus further comprises an image-erasing apparatus that erases an image, developed and recorded by said image-recording apparatus, on said image-developing layer of said image-recording substrate, the image-erasing apparatus comprising a thermal heater that heats said image-recording substrate to a temperature beyond said predetermined glass-transition temperature.

7. A rewriteable image-recording substrate comprising:

a base member; and an image-developing layer, that coasts a surface of said base member, composed of a plurality of split-tube elements including a first type of split-tube element formed of a shape memory resin exhibiting a first predetermined glass-transition temperature, and a second type of split-tube element formed of a shape memory resin exhibiting a second predetermined glass-transition temperature, said first and second types of split-tube elements being regularly and uniformly oriented and arranged over said surface of said base member, wherein a split is formed along a central axis of each of said split-tube elements, and said each split-tube element is securely adhered to said surface of said base member such that said split is oriented away from said surface of said base member, an outer peripheral surface of said first and second types of split-tube elements being colored with a first single-color, an inner cylindrical surface of said first type of split-tube element being colored with a second single-color, an inner cylindrical surface of said second type of split-tube element being colored with a third single-color.

8. An image-recording substrate as set forth in claim 7, wherein said surface of said base member exhibits said first single-color.

9. An image-recording substrate as set forth in claim 8, wherein said first single-color is white.

10. The rewritable image-recording substrate of claim 7, in combination with an image-recording apparatus that develops and records a color image on said image-developing layer of said image-recording substrate, said image-recording apparatus comprising:

a first thermal heater that selectively heats a localized area of said image-developing layer of said image-recording substrate to a temperature beyond said first predetermined glass-transition temperature in accordance with first image-pixel information;

a first pressure applicator that exerts a first predetermined pressure on said localized area, heated by said first thermal heater, such that only said first type of split-tube element, included in said localized area, is deformed and spread-out to exhibit said second single-color;

a second thermal heater that selectively heats a localized area of said image-developing layer of said image-recording substrate to a temperature beyond said second predetermined glass-transition temperature in accordance with second image-pixel information; and a second pressure applicator that exerts a second predetermined pressure on said localized area, heated by said second thermal heater, such that only said second type of split-tube element, included in said localized area, is deformed and spread-out to exhibit said third single-color.

11. The combination of claim 10, wherein the image-recording apparatus further comprises:

a first cooling unit that cools said first type of deformed and spread-out element to a temperature below said first predetermined glass-transition temperature; and a second cooling unit that cools said second type of deformed and spread-out element to a temperature below said second predetermined glass-transition temperature.

12. The combination of claim 10, wherein said image-recording apparatus further comprises an image-erasing apparatus that erases a color image, developed and recorded by said image-recording apparatus, on said image-developing layer of said image-recording substrate, the image-erasing apparatus comprising a thermal heater that heats said image-recording substrate to a temperature beyond said first and second predetermined glass-transition temperatures.

13. A rewriteable image-recording substrate comprising:

a base member; and an image-developing layer, that coasts a surface of said base member, composed of a plurality of split-tube elements including a first type of split-tube element formed of a shape memory resin exhibiting a first predetermined glass-transition temperature, a second type of split-tube element formed of a shape memory resin exhibiting a second predetermined glass-transition temperature, and a third type of split-tube element formed of a shape memory resin exhibiting a third predetermined glass-transition temperature, said first, second and third types of split-tube elements being regularly and uniformly oriented and arranged over said surface of said base member, wherein a split is formed along a central axis of each of said split-tube elements, and said each split-tube element is securely adhered to said surface of said base member such that said split is oriented away from said surface of said base member, an outer peripheral surface of said first, second and third types of split-tube elements being colored with a first single-color, an inner cylindrical surface of said first type of split-tube element being colored with a second single-color, an inner cylindrical surface of said second type of split-tube element being colored with a third single-color, an inner cylindrical surface of said third type of split-tube element being colored with a fourth single-color.

14. An image-recording substrate as set forth in claim 13, wherein said surface of said base member exhibits said first single-color.

15. An image-recording substrate as set forth in claim 14, wherein said first single-color is white.

16. An image-recording substrate as set forth in claim 14, wherein said respective second, third and fourth single-colors are yellow, magenta and cyan.

17. The rewritable image-recording substrate of claim 13, in combination with an image-recording apparatus that develops and records a color image on said image-developing layer of said image-recording substrate, said image-recording apparatus comprising:

a first thermal heater that selectively heats a localized area of said image-developing layer of said image-recording substrate to a temperature beyond said first predetermined glass-transition temperature in accordance with first image-pixel information;

a first pressure applicator that exerts a first predetermined pressure on said localized area, heated by said first thermal heater, such that only said first type of split-tube element, included in said localized area, is deformed and spread-out to exhibit and second single-color;

a second thermal heater that selectively heats a localized area of said image-developing layer of said image-recording substrate to a temperature beyond said second predetermined glass-transition temperature in accordance with second image-pixel information;

a second pressure applicator that exerts a second predetermined pressure on said localized area, heated by said second thermal heater, such that only said second type of split-tube element, included in said localized area, is deformed and spread-out to exhibit and third single-color;

a third thermal theater that selectively heats a localized area of said image-developing layer of said image-recording substrate to a temperature beyond said third predetermined glass-transition temperature in accordance with third image-pixel information; and a third pressure applicator that exerts a third predetermined pressure on said localized area, heated by said third thermal heater, such that only said third type of split-tube element, included in said localized area, is deformed and spread-out to exhibit said fourth single-color.

18. The combination of claim 17, wherein the image-recording apparatus further comprises:

a first cooling unit that cools said first type of deformed and spread-out element to a temperature below said first predetermined glass-transition temperature;

a second cooling unit that cools said second type of deformed and spread-out element to a temperature below said second predetermined glass-transition temperature; and a third cooling unit that cools said third type of deformed and spread-out element to a temperature below said third predetermined glass-transition temperature.

19. The combination of claim 17, wherein said image-recording apparatus further comprises an image-erasing apparatus that erases a color image, developed and recorded by said image-recording apparatus, on said image-developing layer of said image-recording substrate, the image-erasing apparatus comprising a thermal heater that heats said image-recording substrate to a temperature beyond said first, second and third predetermined glass-transition temperatures.

* * * * *